US006550552B1

(12) United States Patent
Pappa et al.

(10) Patent No.: US 6,550,552 B1
(45) Date of Patent: Apr. 22, 2003

(54) METHOD FOR THE REMOVAL AND RECOVERY OF THE OIL COMPONENT FROM DRILL CUTTINGS

(75) Inventors: Rosario Pappa, Monterotondo (IT); Umberto Cova, Rome (IT); Raffaello Sisto, Rome (IT); Armando Marcotullio, S. Donato Mil.se (IT); Antonella Carpentieri, Monterotondo (IT)

(73) Assignee: EniTechnologie S.p.A., San Donato Milanese (IT)

( * ) Notice: Subject to any disclaimer, the term of this patent is extended or adjusted under 35 U.S.C. 154(b) by 133 days.

(21) Appl. No.: 09/657,313

(22) Filed: Sep. 7, 2000

(30) Foreign Application Priority Data

Sep. 9, 1999 (IT) ..... MI99A1888

(51) Int. Cl.[7] ..... B09B 3/00; B09B 21/06

(52) U.S. Cl. ..... 175/66; 134/12; 134/25.1; 134/26; 134/40; 210/768; 210/772; 405/129.25; 507/904

(58) Field of Search ..... 75/66, 206, 207, 75/129.1, 129.2, 129.25; 134/10, 12, 25.1, 26, 40; 210/768, 772; 405/129.1, 129.2, 129.25; 507/904, 910

(56) References Cited

U.S. PATENT DOCUMENTS 4,040,866 A 8/1977 Mondshine ..... 134/26
4,434,028 A * 2/1984 Eppig et al. ..... 196/14.52
4,595,422 A * 6/1986 Hill et al. ..... 175/206 X
4,645,608 A 2/1987 Rayborn ..... 175/66 X
4,836,302 A * 6/1989 Heilhecker et al. ..... 175/66
5,005,655 A * 4/1991 Stokke et al. ..... 175/66
5,053,082 A * 10/1991 Flanigan et al. ..... 134/25.1
5,080,721 A 1/1992 Flanigan et al. ..... 134/26
5,090,498 A * 2/1992 Hamill ..... 134/109
5,092,983 A * 3/1992 Eppig et al. ..... 208/13
5,570,749 A * 11/1996 Reed ..... 175/66
6,177,014 B1 * 1/2001 Potter et al. ..... 210/772 X

OTHER PUBLICATIONS

Weast, Ph.D., Robert C., CRC Handbook of Chemistry and Physics, 57$^{th}$ Edition, 1997, p. C86.*

* cited by examiner

*Primary Examiner*—George Suchfield
(74) *Attorney, Agent, or Firm*—Oblon, Spivak, McClelland, Maier & Neustadt, P.C.

(57) ABSTRACT

Oil drill cuttings, containing an oil-based mud, may be treated by mixing the cuttings with an organic solvent. The oil drill cuttings are then separated from the organic solvent and extracted oil. The organic solvent is then separated from the oil, and mixed with the extracted oil drill cuttings to extract additional oil therefrom. The oil drill cuttings are again separated from the organic solvent and oil, the oil separated from the solvent, and recombined with the oil from the first extraction step. The oil base and other mud components are recycled, depending on the treatment procedure, for subsequent use in drilling.

11 Claims, 1 Drawing Sheet

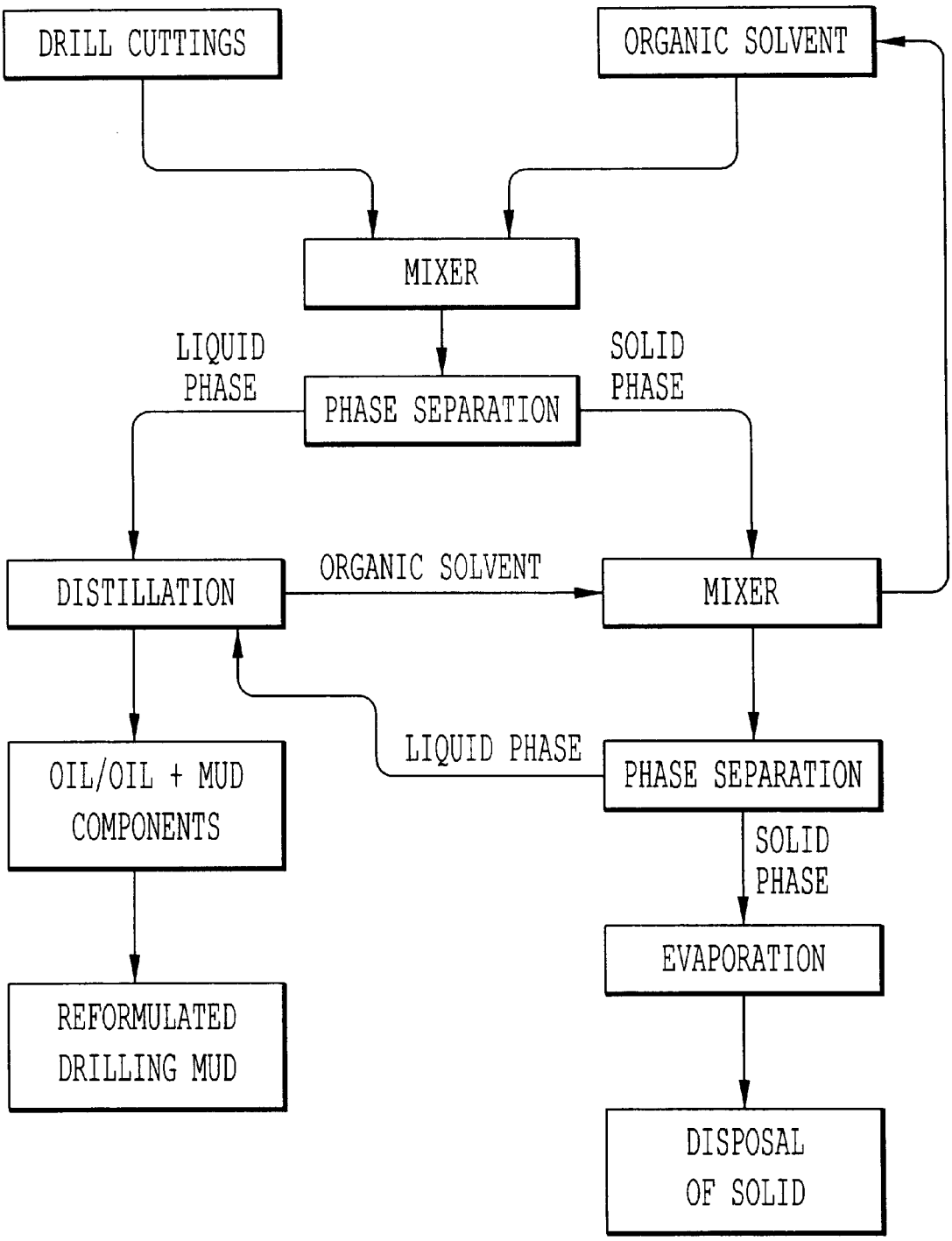
DRILL CUTTINGS
ORGANIC SOLVENT
MIXER
LIQUID PHASE
PHASE SEPARATION
SOLID PHASE
DISTILLATION
ORGANIC SOLVENT
MIXER
LIQUID PHASE
OIL/OIL + MUD COMPONENTS
PHASE SEPARATION
SOLID PHASE
EVAPORATION
REFORMULATED DRILLING MUD
DISPOSAL OF SOLID

METHOD FOR THE REMOVAL AND RECOVERY OF THE OIL COMPONENT FROM DRILL CUTTINGS

BACKGROUND OF THE INVENTION

1. Field of the Invention

The present invention relates to a method for the treatment of oil drill cuttings.

2. Discussion of the Background

As is known, the function of drill mud is to strengthen the walls of the oil well hole, protect metal parts from corrosion, cool and lubricate the bit during drilling. Mud, which can be aqueous-based or oil-based, also provides pressure for keeping the geological formation intact and helps to carry the cuttings produced by the action of the bit in digging, to the surface. Oil-based mud consists of mineral oil, barite, bentonite and other additives such as emulsifying agents and polymers.

In the past, drill cuttings, especially if coming from off-shore platforms, were discharged into the sea creating an unacceptable environmental impact level. There are also great problems for dispersion on land. Various methods are used for removing oil mud from cuttings: among these are washing systems with detergents, thermal and distillation systems. The main disadvantages of these methods are respectively linked to poor efficiency, limited safety, mainly in offshore platforms, high costs and plant construction complexity.

It has now been found that the oil part of cuttings can be removed with a method which uses a simple solvent obtaining a mud which, with the optional addition of additives if necessary, can be re-used in other drillings whereas the soil can be returned to the environment.

SUMMARY OF THE INVENTION

In accordance with this, an objective of the present invention is a method for the removal of the oil component which contaminates drill cuttings and the recovery of oil-based drilling mud, comprising the following steps:

(a) mixing said cuttings with an organic solvent in a ratio ranging from 0.5 to 2, based on the weight of the cuttings thereby forming a mixture of a first solid phase, and a first liquid phase comprising the organic solvent and the oil;

(b) separating the first liquid phase from the first solid phase;

(c) separating the organic solvent from the oil in the separated first liquid phase of step (b);

(d) mixing the separated first solid phase of step (b) with the separated organic solvent of step (c), thereby forming a second solid phase, and a second liquid phase comprising the organic solvent and the oil;

(e) separating the second liquid phase from the second solid phase;

(f) separating the organic solvent from the oil in the separated second liquid phase of step (e);

(g) combining the separated oil of step (c) with the separated oil of step (f);

(h) evaporating residual solvent from the second solid phase;

(i) disposing of said evaporated second solid phase;

(j) preparing an oil-based drilling mud comprising the combined oil of step (g).

BRIEF DESCRIPTION OF THE DRAWINGS

FIG. 1 is a flow chart of the process of the present invention.

DETAILED DESCRIPTION OF THE INVENTION

A typical embodiment of the invention is described with reference to the block scheme illustrated in FIG. 1.

The cuttings coming from well drilling carried out with oil-based mud, are mixed using a tilting mixer or other systems useful for the purpose, with an organic solvent. Under the preferred conditions, the organic solvent is hexane or ethyl acetate.

In this respect, it should be noted that ethyl acetate is not toxic, is easily degradable and therefore environmentally extremely acceptable.

The optimum ratio solvent weight/soil weight ranges from 0.5 to 2 and under the preferred conditions ranges from 0.5 to 1.

After appropriate mixing, the solid phase is separated from the liquid phase by centrifugation or decanting.

If the separation is carried out by centrifugation, a liquid phase is obtained from which the recovery of the solvent (steps (c) and (f)) can be effected with a fine film, scored wall evaporator, operating at atmospheric pressure or in slight depression, obtaining a boiler bottom product containing the oil fraction extracted from the ground and a head fraction consisting of the ethyl acetate extraction solvent. If the separation is carried out by simple decanting, a supernatant consisting of oil and clay is obtained. The solvent can be recovered from this phase using the procedure described above. In this case the tail fraction consists of oil and clay which can be recycled to the drilling system for the formulation of fresh mud.

The cuttings which form the solid part of step (e) can be dried, before being returned to the environment, using commercial type equipment at a temperature of about 80° C. in order to remove the extraction solvent residues.

The method according to the present invention has considerable economic and environmental advantages. The drill cuttings, in fact, have such characteristics as to make them environmentally compatible after treatment, whereas the oil part removed, with suitable additives, can be reused, if necessary, as drilling mud.

The following examples provide a better understanding of the invention and should not be considered as limiting its scope in any way.

EXAMPLE 1

A sample of drill cuttings deriving from the use of oil-based mud, was taken from a drilling well, downstream of the coarse material separation by means of shale shaking.

The sample, thus consisting of drilling mud and cuttings of a clay nature, was characterized by an oil content equal to 10.5% and a degree of humidity of 2.8%. 500 g of this sample were charged into a two liter glass flask equipped with a blade stirrer and treated with 500 g of ethyl acetate and stirred for 15 minutes. The suspension was centrifuged at 2,500 revs for two minutes, separating 445 g of solid to be subjected to subsequent washings.

The liquid phase, consisting of ethyl acetate and the oil extracted from the cutting, was distilled in a rotating laboratory evaporator at 90° C., 10,000 Pa, recovering ethyl acetate without hydrocarbons (gas chromatography) in the head fraction, which was used in the subsequent extraction treatment.

The tail fraction, collected in the distiller boiler, consisted of the oil-base used for the preparation of the drilling mud.

The solid residue obtained from the centrifugation was subjected to a further two washing cycles with the ethyl acetate recovered as described above, obtaining at the end of the extraction operations, the following streams:

435 g of dry cuttings, classifiable as non-dangerous waste, according to D.M. 5-2-98, as they contain 600 ppm of residual hydrocarbons and less than 5 ppm of aromatic polycyclic hydrocarbons, or, on the basis of the same characteristics, as reclaimed earth according to the acceptability limits for soil destined for residential/industrial use according to Tuscan Region regulation Nr. 36 of 16-3-93.

51 g of oil without solvent, re-usable for the preparation of fresh drilling mud.

EXAMPLE 2

700 g of a sample analogous to that used in example 1, characterized by an oil content of 15% and the same water content, were treated with 700 g of ethyl acetate in a 2 liter flask equipped with a blade stirrer. After 15 minutes of stirring, the suspension was decanted for 30 minutes, the coarse fraction being deposited in the flask and the supernatant, consisting of the extraction solvent, extracted oil and fine clay fraction of the cutting, being sucked up.

The supernatant was subjected to centrifugation at 2,500 revs for 2 minutes, recovering a fine solid fraction and a supernatant which was distilled under the same conditions described in example 1.

The solvent recovered from the distillation was added to the decanted solid in the flask, which was then extracted as in the first cycle.

The separation of the solid and liquid fractions was then repeated as in the first washing cycle, recovering at the end of the operations:

402 g of cuttings containing 680 ppm of total hydrocarbons and less than 5 ppm of aromatic polycyclic hydrocarbons, re-usable according to the Law provisions cited above.

173 g of fine dry clay material, containing 500 ppm of total hydrocarbons and less than 5 ppm of aromatic polycyclic hydrocarbons, classifiable as non-dangerous waste according to the same criteria or usable for the preparation of fresh mud.

105 g of oil without solvent re-usable for the preparation of fresh mud.

EXAMPLE 3

700 g of the same sample used in example 2 were treated with 700 g of ethyl acetate under the same conditions. After 30 minutes of sedimentation, the supernatant was sucked up and distilled directly, without effecting the separation of the fine clay material.

The solvent thus recovered was recycled to a second washing of the solid material remaining in the flask; the separation of the fractions was carried out using the same procedure adopted for the first cycle.

At the end of the operations the following products were obtained:

400 g of cuttings, containing 720 ppm of total hydrocarbons and less than 5 ppm of aromatic polycyclic hydrocarbons, re-usable according to the previous criteria.

280 g of oil/clay mixture, re-usable for the formulation of fresh drilling mud.

EXAMPLE 4

Considering the fact that in many cases the mud leaves the drilling well at a temperature higher than the environmental value (generally between 40 and 80° C.), an extraction test was carried out operating at 80° C.

For this purpose, the extraction flask was equipped with a water-cooled reflux cooler, in order to condense the solvent vapors.

The operating procedure is identical to that described in example 3, obtaining at the end of the operations:

394 g of cuttings, containing 500 ppm of total hydrocarbons and less than 5 ppm of aromatic polycyclic hydrocarbons, re-usable according to the previous criteria.

283 g of oil/clay mixture, re-usable for the formulation of fresh drilling mud.

EXAMPLE 5

The same procedure is adopted as described in example 3, using n-hexane as extraction solvent.

700 grams of the same sample used in example 2 were treated with 700 g of n-hexane at 80° C. in the reflux flask used in example 4. After 30 minutes of sedimentation at room temperature, the supernatant was sucked up and distilled directly, without effecting the separation of the fine clay material.

The solvent thus recovered was recycled to a second washing of the solid material remaining in the flask; the separation of the fractions was carried out using the same procedure adopted for the first cycle.

At the end of the operations the following products were obtained:

402 g of cuttings, containing 742 ppm of total hydrocarbons and less than 5 ppm of aromatic polycyclic hydrocarbons, re-usable according to the previous criteria.

281 g of oil/clay mixture, re-usable for the formulation of fresh drilling mud.

What is claimed is:

1. A method for recovering and recycling an oil from drill cuttings contaminated with an oil-based drilling mud, comprising:

(a) mixing said drill cuttings with an organic solvent in a ratio of 0.5 to 2, based on the weight of the drill cuttings, thereby forming a mixture of a first solid phase, and a first liquid phase comprising the organic solvent and the oil;

(b) separating the first liquid phase from the first solid phase;

(c) separating the organic solvent from the oil in the separated first liquid phase of step (b);

(d) mixing the separated first solid phase of step (b) with the separated organic solvent of step (c), thereby forming a second solid phase, and a second liquid phase comprising the organic solvent and the oil;

(e) separating the second liquid phase from the second solid phase;

(f) separating the organic solvent from the oil in the separated second liquid phase of step (e);

(g) combining the separated oil of step (c) with the separated oil of step (f);

(h) evaporating residual solvent from the second solid phase;

(i) disposing of said evaporated second solid phase;

(j) preparing an oil-based drilling mud comprising the combined oil of step (g).

2. The method of claim 1, wherein the ratio of step (a) is 0.5 to 1.

3. The method of claim 1, wherein the organic solvent is ethyl acetate.

4. The method of claim 1, wherein the organic solvent is hexane.

5. The method of claim 1, wherein said separating of step (b) and step (e) is by centrifugation.

6. The method of claim 1, wherein said separating of step (b) and step (e) is by decantation.

7. The method of claim 1, wherein said separating of step (c) and step (f) is carried out at or slightly below atmospheric pressure with a fine film, scored wall evaporator.

8. The method of claim 1, wherein the separated oil of steps (c) and (f) comprises a mixture of oil and clay.

9. In a method for recovering and recycling an oil from drill cuttings contaminated with an oil-based drilling mud, including the steps of:

(a) mixing said drill cuttings with an organic solvent thereby forming a mixture of a first solid phase, and a first liquid phase comprising the organic solvent and the oil;

(b) separating the first liquid phase from the first solid phase;

(c) separating the organic solvent from the oil in the separated first liquid phase of step (b);

(d) mixing the separated first solid phase of step (b) with the separated organic solvent of step (c), thereby forming a second solid phase, and a second liquid phase comprising the organic solvent and the oil;

(e) separating the second liquid phase from the second solid phase;

(f) separating the organic solvent from the oil in the separated second liquid phase of step (e);

(g) evaporating residual solvent from the second solid phase;

(h) disposing of the evaporated second solid phase; wherein the improvement comprises:

(i) combining the separated oil of step (c) with the separated oil of step (f); and (j) preparing an oil-based drilling mud comprising the combined oil of step (i).

10. The method of claim 9, wherein the organic solvent is ethyl acetate.

11. The method of claim 9, wherein the organic solvent is hexane.

* * * * *